US008450664B2

(12) United States Patent
Parsche

(10) Patent No.: US 8,450,664 B2
(45) Date of Patent: May 28, 2013

(54) RADIO FREQUENCY HEATING FORK

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 352 days.

(21) Appl. No.: 12/835,331

(22) Filed: Jul. 13, 2010

(65) Prior Publication Data

US 2012/0012575 A1 Jan. 19, 2012

(51) Int. Cl.
*H05B 6/02* (2006.01)

(52) U.S. Cl.
USPC ..... 219/600; 219/672; 166/248

(58) Field of Classification Search
USPC 216/600, 672; 333/219.1; 177/248; 219/600, 219/672, 673; 166/248
See application file for complete search history.

(56) References Cited

U.S. PATENT DOCUMENTS

| | | | | |
|---|---|---|---|---|
| 2,283,914 | A | 5/1942 | Carter et al. | |
| 2,371,459 | A | 3/1945 | Mittelmann | |
| 2,433,067 | A | 12/1947 | Russell | |
| 2,507,528 | A | 5/1950 | Kandoian et al. | |
| 2,685,930 | A | 8/1954 | Albaugh | |
| 2,723,517 | A | 11/1955 | Mittelmann | |
| 3,497,005 | A | 2/1970 | Pelopsky | |
| 3,535,597 | A * | 10/1970 | Kendrick | 361/143 |
| 3,848,671 | A | 11/1974 | Kern | |
| 3,954,140 | A | 5/1976 | Hendrick | |
| 3,988,036 | A | 10/1976 | Fisher | |
| 3,991,091 | A | 11/1976 | Driscoll | |
| 4,035,282 | A | 7/1977 | Stuchberry et al. | |
| 4,042,487 | A | 8/1977 | Seguchi | |
| 4,087,781 | A | 5/1978 | Grossi et al. | |
| 4,136,014 | A | 1/1979 | Vermeulen | |

(Continued)

FOREIGN PATENT DOCUMENTS

| | | |
|---|---|---|
| CA | 1199573 A1 | 1/1986 |
| CA | 2678473 | 8/2009 |

(Continued)

OTHER PUBLICATIONS

PCT Notification of Transmittal of the International Search Report and The Written Opinion of the International Searching Authority, or the Declaration, in PCT/US2010/025761, dated Feb. 9, 2011.

(Continued)

*Primary Examiner* — Caridad Everhart
(74) *Attorney, Agent, or Firm* — Allen, Dyer, Doppelt, Milbrath & Gilchrist, P.A.

(57) ABSTRACT

An apparatus for heating a target comprises a radio frequency heating fork having two substantially parallel tines, the substantially parallel tines electrically connected at a loop end of the radio frequency heating fork, and the substantially parallel tines separated at an open end of the radio frequency heating fork, and a feed coupler connection, the feed coupler connection connecting a power source across the substantially parallel tines of the radio frequency heating fork. The application of power across the substantially parallel tines of the radio frequency heating fork results in induction heating near the loop end of the radio frequency heating fork, and dielectric heating near the open end of the radio frequency tuning fork. A target can be positioned relative to the heating fork to select the most efficient heating method. The heating fork can provide near fields at low frequencies for deep heat penetration.

27 Claims, 3 Drawing Sheets

U.S. PATENT DOCUMENTS 4,140,179 A 2/1979 Kasevich et al.
4,140,180 A 2/1979 Bridges et al.
4,144,935 A 3/1979 Bridges et al.
4,146,125 A 3/1979 Sanford et al.
4,196,329 A 4/1980 Rowland et al.
RE30,738 E * 9/1981 Bridges et al. ..... 166/248
4,295,880 A 10/1981 Horner
4,300,219 A 11/1981 Joyal
4,301,865 A 11/1981 Kasevich et al.
4,328,324 A 5/1982 Kock
4,373,581 A * 2/1983 Toellner ..... 166/53
4,396,062 A 8/1983 Iskander
4,404,123 A 9/1983 Chu
4,410,216 A 10/1983 Allen
4,425,227 A 1/1984 Smith
4,449,585 A 5/1984 Bridges et al.
4,456,065 A 6/1984 Heim
4,457,365 A 7/1984 Kasevich et al.
4,470,459 A 9/1984 Copland
4,485,869 A 12/1984 Sresty
4,487,257 A 12/1984 Dauphine
4,508,168 A 4/1985 Heeren
4,514,305 A 4/1985 Filby
4,524,827 A 6/1985 Bridges
4,531,468 A 7/1985 Simon
4,583,586 A 4/1986 Fujimoto et al.
4,620,593 A 11/1986 Haagensen
4,622,496 A 11/1986 Dattili
4,638,571 A * 1/1987 Cook ..... 34/255
4,645,585 A 2/1987 White
4,678,034 A 7/1987 Eastlund
4,703,433 A 10/1987 Sharrit
4,780,678 A * 10/1988 Kleinberg et al. ..... 324/338
4,790,375 A 12/1988 Bridges
4,817,711 A 4/1989 Jeambey
4,882,984 A 11/1989 Eves, II
4,892,782 A 1/1990 Fisher et al.
5,046,559 A 9/1991 Glandt
5,055,180 A 10/1991 Klaila
5,065,819 A 11/1991 Kasevich
5,082,054 A 1/1992 Kiamanesh
5,087,804 A * 2/1992 McGaffigan ..... 219/618
5,136,249 A 8/1992 White
5,199,488 A 4/1993 Kasevich
5,233,306 A 8/1993 Misra
5,236,039 A 8/1993 Edelstein
5,251,700 A 10/1993 Nelson
5,293,936 A * 3/1994 Bridges ..... 166/248
5,304,767 A 4/1994 MacGaffigan
5,315,561 A 5/1994 Grossi
5,370,477 A 12/1994 Bunin
5,378,879 A 1/1995 Monovoukas
5,484,985 A 1/1996 Edelstein et al.
5,506,592 A 4/1996 MacDonald
5,582,854 A 12/1996 Nosaka
5,621,844 A 4/1997 Bridges
5,631,562 A 5/1997 Cram
5,746,909 A 5/1998 Calta
5,910,287 A 6/1999 Cassin
5,923,299 A 7/1999 Brown et al.
6,045,648 A 4/2000 Palmgren et al.
6,046,464 A 4/2000 Schetzina
6,055,213 A 4/2000 Rubbo
6,063,338 A 5/2000 Pham
6,097,262 A 8/2000 Combellack
6,106,895 A 8/2000 Usuki
6,112,273 A 8/2000 Kau
6,184,427 B1 2/2001 Klepfer
6,229,603 B1 5/2001 Coassin
6,232,114 B1 5/2001 Coassin
6,301,088 B1 10/2001 Nakada
6,303,021 B2 10/2001 Winter et al.
6,348,679 B1 2/2002 Ryan et al.
6,360,819 B1 3/2002 Vinegar
6,432,365 B1 8/2002 Levin
6,559,428 B2 * 5/2003 Panczner ..... 219/615
6,603,309 B2 8/2003 Forgang
6,613,678 B1 9/2003 Sakaguchi
6,614,059 B1 9/2003 Tsujimura
6,649,888 B2 11/2003 Ryan et al.
6,712,136 B2 3/2004 de Rouffignac
6,808,935 B2 10/2004 Levin
6,923,273 B2 8/2005 Terry
6,932,155 B2 8/2005 Vinegar
6,967,589 B1 11/2005 Peters
6,992,630 B2 1/2006 Parsche
7,046,584 B2 5/2006 Sorrells
7,079,081 B2 7/2006 Parsche et al.
7,091,460 B2 8/2006 Kinzer
7,109,457 B2 9/2006 Kinzer
7,115,847 B2 10/2006 Kinzer
7,147,057 B2 12/2006 Steele
7,172,038 B2 2/2007 Terry
7,205,947 B2 4/2007 Parsche
7,312,428 B2 12/2007 Kinzer
7,322,416 B2 1/2008 Burris, II
7,337,980 B2 3/2008 Schaedel
7,438,807 B2 10/2008 Garner et al.
7,441,597 B2 10/2008 Kasevich
7,461,693 B2 12/2008 Considine et al.
7,484,561 B2 2/2009 Bridges
7,562,708 B2 7/2009 Cogliandro
7,623,804 B2 11/2009 Sone
2002/0032534 A1 3/2002 Regier
2002/0149425 A1 * 10/2002 Chawla et al. ..... 330/251
2004/0031731 A1 2/2004 Honeycutt
2005/0199386 A1 9/2005 Kinzer
2005/0199615 A1 * 9/2005 Barber et al. ..... 219/672
2005/0274513 A1 12/2005 Schultz
2006/0038083 A1 2/2006 Criswell
2007/0108202 A1 5/2007 Kinzer
2007/0131591 A1 6/2007 Pringle
2007/0137852 A1 6/2007 Considine et al.
2007/0137858 A1 6/2007 Considine et al.
2007/0187089 A1 8/2007 Bridges
2007/0261844 A1 11/2007 Cogliandro et al.
2008/0073079 A1 3/2008 Tranquilla
2008/0143330 A1 6/2008 Madio
2009/0009410 A1 1/2009 Dolgin et al.
2009/0242196 A1 10/2009 Pao
2011/0042063 A1 * 2/2011 Diehl et al. ..... 166/60

FOREIGN PATENT DOCUMENTS

DE 10 2008 022176 A1 11/2009
EP 0 135 966 4/1985
EP 0418117 A1 3/1991
EP 0563999 A2 10/1993
EP 1106672 A1 6/2001
FR 1586066 A 2/1970
FR 2925519 A1 6/2009
JP 56050119 A 5/1981
JP 2246502 A 10/1990
WO WO 2007/133461 11/2007
WO WO2008/011412 A2 1/2008
WO WO 2008/030337 3/2008
WO WO2008098850 A1 8/2008
WO WO2009027262 A1 8/2008
WO WO2009/114934 A1 9/2009

OTHER PUBLICATIONS

PCT Notification of Transmittal of the International Search Report and The Written Opinion of the International Searching Authority, or the Declaration, in PCT/US2010/057090, dated Mar. 3, 2011.

"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm).

Von Hippel, Arthur R., Dielectrics and Waves, Copyright 1954, Library of Congress Catalog Card No. 54-11020, Contents, pp. xi-xii; Chapter II, Section 17, "Polyatomic Molecules", pp. 150-155; Appendix C-E, pp. 273-277, New York, John Wiley and Sons.

United States Patent and Trademark Office, Non-final Office action issued in U.S. Appl. No. 12/396,247, dated Mar. 28, 2011.

United States Patent and Trademark Office, Non-final Office action issued in U.S. Appl. No. 12/396,284, dated Apr. 26, 2011.

Patent Cooperation Treaty, Notification of Transmittal of the International Search Report and The Written Opinion of the International Searching Authority, or the Declaration, in PCT/US2010/025808, dated Apr. 5, 2011.
Deutsch, C.V., McLENNAN, J.A., "The Steam Assisted Gravity Drainage (SSGD) Process," Guide to SAGD (Steam Assisted Gravity Drainage) Reservoir Characterization Using Geostatistics, Centre for Computational Statistics (CCG), Guidebook Series, 2005, vol., 3; p. 2, section 1.2, published by Centre for Computational Statistics, Edmonton, AB, Canada.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers, © 1986.
Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of The Institution of Electrical Engineers, © 1986.
"Oil sands." Wikipedia, the free encyclopedia. Retrieved from the Internet from: http://en.wikipedia.org/w/index.php?title=Oil_sands &printable=yes, Feb. 16, 2009.
Sahni et al., "Electromagnetic Heating Methods for Heavy Oil Reservoirs." 2000 Society of Petroleum Engineers SPE/AAPG Western Regional Meeting, Jun. 19-23, 2000.
Power et al., "Froth Treatment: Past, Present & Future." Oil Sands Symposium, University of Alberta, May 3-5, 2004.
Flint, "Bitumen Recovery Technology a Review of Long Term R&D Opportunities." Jan. 31, 2005. LENEF Consulting (1994) Limited.
"Froth Flotation." Wikipedia, the free encyclopedia. Retrieved from the internet from: http://en.wikipedia.org/wiki/Froth_flotation, Apr. 7, 2009.
"Relative static permittivity." Wikipedia, the free encyclopedia. Retrieved from the Internet from http://en.wikipedia.org/w/index/php?title=Relative_static_permittivity&printable=yes, Feb. 12, 2009.
"Tailings." Wikipedia, the free encyclopedia. Retrieved from the Internet from http://en.wikipedia.org/w/index.php?title=Tailings &printable=yes, Feb. 12, 2009.
"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045.
Sahni et al., "Electromagnetic Heating Methods for Heavy Oil Reservoirs," U.S. Department of Energy, Lawrence Livermore National Laboratory, May 1, 2000, UCL-JC-138802.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
Kinzer, A Review of Notable Intellectual Property for In Situ Electromagnetic Heating of Oil Shale, Quasar Energy LLC.
A. Godio: "Open ended-coaxial Cable Measurements of Saturated Sandy Soils", American Journal of Environmental Sciences, vol. 3, No. 3, 2007, pp. 175-182, XP002583544.
Carlson et al., "Development of the I IT Research Institute RF Heating Process for In Situ Oil Shale/Tar Sand Fuel Extraction—An Overview", Apr. 1981.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
PCT International Search Report and Written Opinion in PCT/US2010/025765, Jun. 30, 2010.
PCT International Search Report and Written Opinion in PCT/US2010/025772, Aug. 9, 2010.
U.S. Appl. No. 12/886,338, filed Sep. 20, 2010 (unpublished).
Butler, R.M. "Theoretical Studies on the Gravity Drainage of Heavy Oil During In-Situ Steam Heating", Can J. Chem Eng, vol. 59, 1981.
Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.
Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.
Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.
Das, S.K. and Butler, R.M., "Diffusion Coefficients of Propane and Butane in Peace River Bitumen" Canadian Journal of Chemical Engineering, 74, 988-989, Dec. 1996.
Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. And Gunnewick, L., "Dew Point vs. Bubble Point: a Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Pretroleum Engineers held in Washington, DC, Oct. 4-7, 1992.

Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", presented at the SPE 69th Annual Technical Conference and Exhibition held in New Orleans LA, USA, Sep. 25-28, 1994.
Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Hear Transfer Fundamentals for Electro-thermal Heating of Oil Reservoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K., Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.
Sresty, G.C., Dev, H., Snow, R.H. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing and Other Enhancement on Solvent Aided Process", Journal of Canadian Petroleum Technology, vol. 46, No. 9, pp. 57-61, Sep. 2007.

* cited by examiner

RADIO FREQUENCY HEATING FORK

STATEMENT REGARDING FEDERALLY SPONSORED RESEARCH OR DEVELOPMENT

[Not Applicable]

CROSS REFERENCE TO RELATED APPLICATIONS

[Not Applicable]

BACKGROUND OF THE INVENTION

The present invention relates to radio frequency ("RF") heating. In particular, the present invention relates to an advantageous and efficient apparatus and method for heating substances of varying conductivities.

RF heating can be used in a variety of applications. For example, oil well core samples can be heated using RF energy. These core samples, however, can vary greatly in conductivity, and therefore respond differently to various types of heating. Dielectric heating is efficient and preferable for samples having a low conductivity. Samples with higher conductivity are best heated by inductive heating. Medical diathermy, or the use of heat to destroy abnormal or unwanted cells, is another application that may utilize RF heating.

RF heating is a versatile process for suitable for many materials as different RF energies may be used. There can be electric fields E, magnetic fields H, and or electric currents I introduced by the RF heating applicator. Linear applicators, such as a straight wire dipole emphasize strong radial near E fields by divergence of current I. Circular applicators, such as a wire loop emphasize strong radial H fields by curl of current I. Hybrid applicator forms may include the helix and spiral to produce both strong E and H fields. Uninsulated RF heating applicators may act as electrodes to introduce electric currents I in the media.

Parallel linear conductors form an antenna in U.S. Pat. No. 2,283,914, entitled "Antenna" to P. S. Carter. Now widely known as the folded dipole antenna, the antenna uses equal direction current flows in the thin wires and a voltage summing action to bring the driving impedance to a higher value. The folded dipole antenna did not, however, include aspects of: antiparallel current flow (opposite current directions or senses), operation with open terminals at one end, induction coupling to a separate feed structure, or capacitor loading. The folded dipole antenna is useful for operation at sizes of about ½ wavelength and above.

U.S. Pat. No. 2,507,528 entitled "Antenna" to A. G. Kandoian describes antiparallel (equal but opposite direction) currents flowing on the opposite edges of a slot in a conductive plate. Horizontal polarization was realized from a vertically oriented slot.

RF heating may operate by near fields or far fields. Near fields are strong reactive energies that circulate near RF heating applicators. Far fields may comprise radio waves at a distance from the applicator. Both near and far fields are useful for RF heating, and many tradeoffs are possible. For instance, near fields may be more useful for low frequencies, when the applicator is small in size, and for conductive materials. Far fields may be preferred for heating at a distance and for heating low conductivity materials.

SUMMARY OF THE INVENTION

The present radio frequency heating fork is useful for heating a variety of targets because the heat produced by the radio frequency heating fork includes induction heating and dielectric heating. A particular type of heating can be selected simply by positioning the target relative to the radio frequency heating fork.

The present radio frequency heating fork includes a method for heating a target using a radio frequency heating fork, the radio frequency heating fork comprising two substantially parallel tines, the substantially parallel tines electrically connected at a loop end of the radio frequency heating fork, and the substantially parallel tines separated at an open end of the radio frequency heating fork, and a feed coupler connection, the feed coupler connection connecting a power source across the substantially parallel tines of the radio frequency heating fork, the method comprising: positioning a target relative to a radio frequency heating fork; and heating the target by applying power across the radio frequency heating fork using a feed coupler connection.

The positioning of the target may further comprise relatively positioning the target between the substantially parallel tines of the radio frequency heating fork. The positioning of the target may further comprise relatively positioning the target on or between the substantially parallel tines of the radio frequency heating fork, and near the loop end of the radio frequency heating fork, where the heating of the target is primarily due to induction heating. Alternatively, the positioning of the target may further comprise relatively positioning the target on or between the substantially parallel tines of the radio frequency heating fork, and near the open end of the radio frequency heating fork, where the heating of the target is primarily due to dielectric heating.

The feed coupler connection may be inductively connected to the substantially parallel tines of the radio frequency heating fork near the loop end of the radio frequency heating fork. Alternatively, the feed coupler connection may be electrically connected to the substantially parallel tines of the radio frequency heating fork near the loop end of the radio frequency heating fork. The induction feed coupler connection may include a Balun. Furthermore, the frequency radio frequency heating fork may be tuned using a capacitor placed across the substantially parallel tines of the radio frequency heating fork.

The present radio frequency heating fork includes an apparatus for radio frequency heating of a target, the apparatus comprising: a radio frequency heating fork, the radio frequency heating fork having two substantially parallel tines, the substantially parallel tines electrically connected at a loop end of the radio frequency heating fork, and the substantially parallel tines separated at an open end of the radio frequency heating fork, and a feed coupler connection, the feed coupler connection connecting a power source across the substantially parallel tines of the radio frequency heating fork. The application of power across the substantially parallel tines of the radio frequency heating fork results in induction heating near the loop end of the radio frequency heating fork, and dielectric heating near the open end of the radio frequency tuning fork.

The feed coupler connection may be inductively connected to the substantially parallel tines of the radio frequency heating fork near the loop end of the radio frequency heating fork. The induction feed coupler connection may include a Balun. Alternatively, the feed coupler connection may be electrically connected to the substantially parallel tines of the radio frequency heating fork near the loop end of the radio frequency heating fork. A capacitor may also be connected between the substantially parallel tines of the radio frequency heating fork.

Other aspects of the invention will be apparent to one of ordinary skill in the art in view of this disclosure.

DETAILED DESCRIPTION OF THE PREFERRED EMBODIMENTS

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

Figure 1:
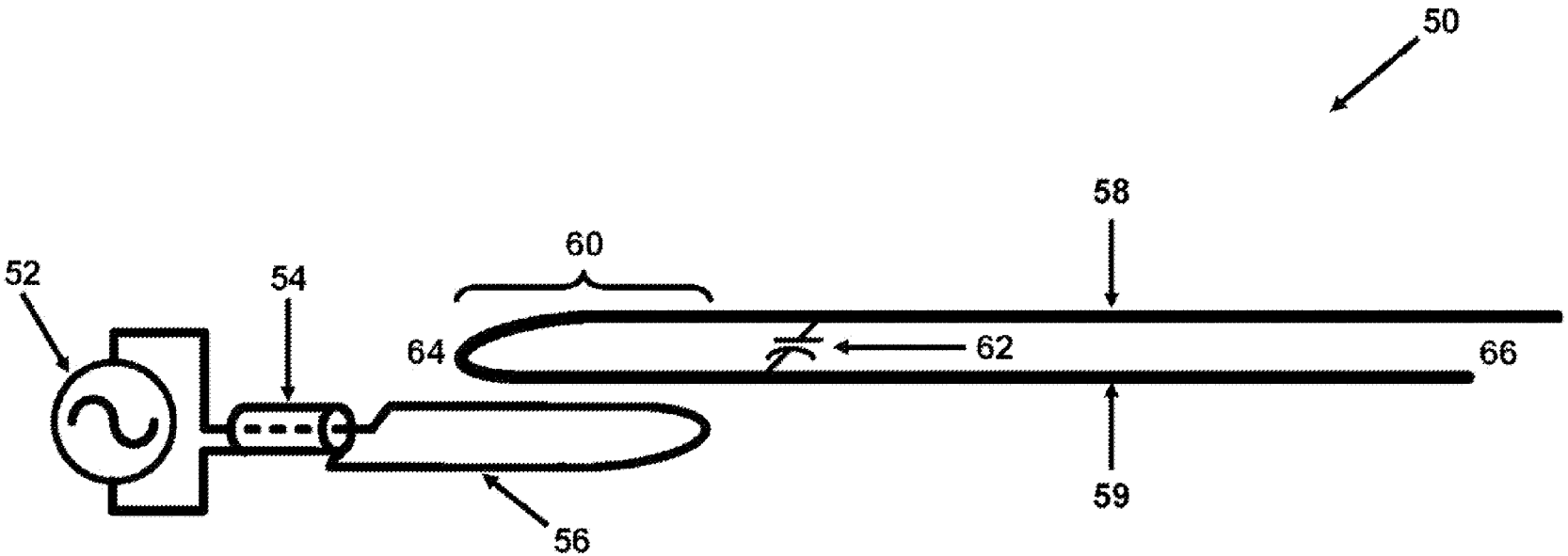
FIG. 1 depicts the present radio frequency heating fork employing a wireless connection.

In FIG. 1, a radio frequency heating fork 50 includes tines 58 and 59, and incorporates a wireless, induction feed coupler connection. A coaxial feed 54 is connected at one end to AC power supply 52, and at the other end to supply loop 56. The supply loop 56 and the loop end 64 of the heating fork 50 are positioned near each other and overlap, which creates a transformer effect that transfers energy from the supply loop 56 to the heating fork 50. The induction feed coupler may be adjusted for a fifty Ohm drive resistance or as desired. The amount of overlap and the distance between supply loop 56 and loop end 64 of heating fork 50 can be varied, which in turn varies the resistance and heating. Tines 58 and 59 are electrically connected through loop end 64. Insulation may be placed over the outside or the heating fork 50 as may be desirable for internal medical diathermy applications.

Heating fork 50 may be optionally equipped with capacitor 62 for tuning purposes. Heating fork 50 naturally operates at a frequency of approximately one-quarter of a wavelength. Optional capacitor 62 can reduce this frequency to, for example, one-twentieth or one-thirtieth of a wavelength. RF shielding (not shown), such as a metal box, may be used over the heating for 50 to control radiation. Supply loop 56 advantageously functions as an isolation transformer or Balun which serves as a common mode choke for stray current suppression on the surface of coaxial feed 54. Although not shown, heating fork 50 may be immersed or otherwise positioned inside a target media to be RF heated.

The length L of heating fork 50 is preferentially one-quarter of a wavelength at the operating frequency, although L may be made shortened as desired adding or increasing the capacitance of capacitor 62. High voltages and high currents are thus easily produced by the heating fork as the hyperbolic tangent function asymptotically approaches zero and infinity through one-quarter of a wavelength, e.g. 90 electrical degrees.

Figure 2:
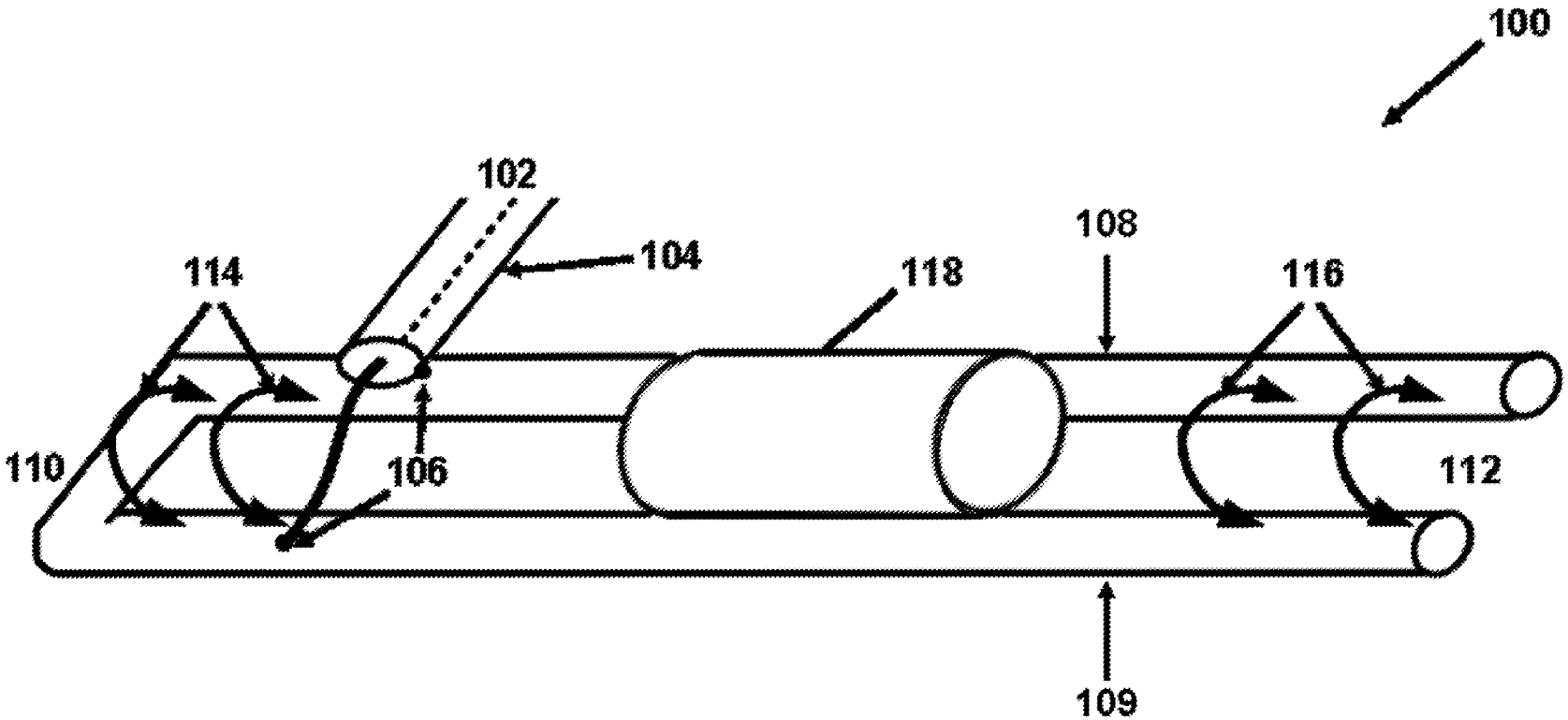
FIG. 2 depicts the present radio frequency heating fork employing a hard-wired connection.

Turning now to FIG. 2, radio frequency heating fork 100 includes tines 108 and 109, and incorporates a hardwired feed coupler connection. Coaxial feed 104 is connected at one end to an AC power supply (not shown), and connected at the other end to heating fork 100 at feed coupler connections 106 near loop end 110 of heating fork 100. Tines 108 and 109 are electrically connected through loop end 110. When power is applied across heating fork 100, a strong magnetic field 114 is formed near loop end 110 of heating fork 100. Conversely, a strong electric field 116 is formed near open end 112 of heating fork 100. These fields are similarly formed when power is applied to heating fork 50 in FIG. 1 (not shown).

The two different fields provide two different heating qualities. The strong magnetic field 114 formed near loop end 110 of heating fork 100 provides induction heating, which is excellent for heating conductive substances. The strong electric field 116 formed near open end 112 of heating fork 100, on the other hand, is excellent for heating less conductive, or even non-conductive substances. By positioning target 118 relative to heating fork 100, the most advantageous form of heating can be used depending on the conductivity of target 118. For example, a target 118 having a high conductivity may be positioned closer to loop end 110 of heating fork 100. On the other hand, even a target comprised of distilled water can be heated near the open end of heating fork 100 due to the strong electric field in that area. More even heating may be achieved if target 100 is positioned between tines 108 and 109 of heating fork 100.

The present radio frequency heating fork has a low voltage standing wave ratio ("VSWR") when operated in an appropriate frequency range. For example, in one embodiment the VSWR approached 1:1 when the radio frequency heating fork was operated at approximately 27 MHz.

Heating fork tines 58, 59, 108 and 109 need not be cylindrical in cross section, and other shapes may be desirable for specific applications. For instance, if used for internal medical diathermy, the fork tines may have a C-shaped cross section to facilitate tissue penetration for positioning the heating fork relative to the target cells.

Heating forks 50 and 100 are conductive structures, typically comprised of a metal, having a differential mode electric current distribution with equal current amplitudes on each tine, with currents flowing in opposite directions on each tine. For example, when the AC power supply waveform is sinusoidal the current distribution along heating fork 50 of FIG. 1 is sinusoidal such that maximum amplitude occurs at the loop end 68, and a minimum at the open end 68. The voltage potential across fork tines 58 and 59 is at a minimum at loop end 64 and at a maximum at the open end 66. The ratio of the voltage E between the tines to the current I along the tines line is the impedance Z is given by:

$$Z_L=\gamma L$$

Where:

$Z_L$=the impedance along the length of the tines $\gamma$=the complex propagation constant gamma along the fork (including an attenuation constant $\alpha$ and a phase propagation constant $\beta$)

L=the overall length of the heating fork from the loop end 64 to the open end 66

Continuing the theory of operation with reference to FIG. 1, supply loop 56 conveys an electric current I in a curl causing a magnetic field B (not shown). Loop end 64 of heating fork 50 overlaps the magnetic field B of supply loop 56 causing a sympathetic electric current I flow into heating fork 50. Thus supply loop 56 and loop end 64 essentially form the "windings" of a transformer in region 60. Bringing supply loop 56 closer to loop end 64 provides a greater load resistance to AC power supply 52, while moving supply loop 56 further from loop end 64 provides less load resistance to AC supply 52. The frequency of resonance of heating fork 50 becomes slightly less as supply loop 56 is brought near loop end 64.

The fields generated by heating forks 50 and 100 are now considered. Although skeletal in form, the heating fork structure relates to linear slot antennas, and heating forks 50 and 100 generate three reactive near fields, three middle fields, and two radiated far fields (E and H). The present radio frequency heating forks primarily utilize near-field heating. Without a heating load, the near fields may be described as follows:

$$H_z=-jE_0/2\pi\eta[(e^{-jkr1}/r_1)+(e^{-jkr2}/r_2)]$$

$$H_\rho=-jE_0/2\pi\eta[(z-\lambda/4)/\rho)(e^{-jkr1}/r_1)+(z-\lambda/4)/\rho)(e^{-jkr2}/r_2)]$$

$$E_\phi=-jE_0/2\pi[(e^{-jkr1})+(e^{-jkr2})]$$

Where:

p, ϕ, z are the coordinates of a cylindrical coordinate system in which the slot is coincident with the Z axis $r_1$ and $r_2$ are the distances from the heating fork to the point of observation η=the impedance of free space=120π

E=the electric field strength in volts per meter

H=the magnetic field strength in amperes per meter

There are strong near E fields broadside to the plane of heating forks 50 and 100 during the heating process. The near H fields are strong broadside to the plane of heating fork 50 and 100, and in between tines 58 and 59 or 108 and 109 as well.

Figure 3:
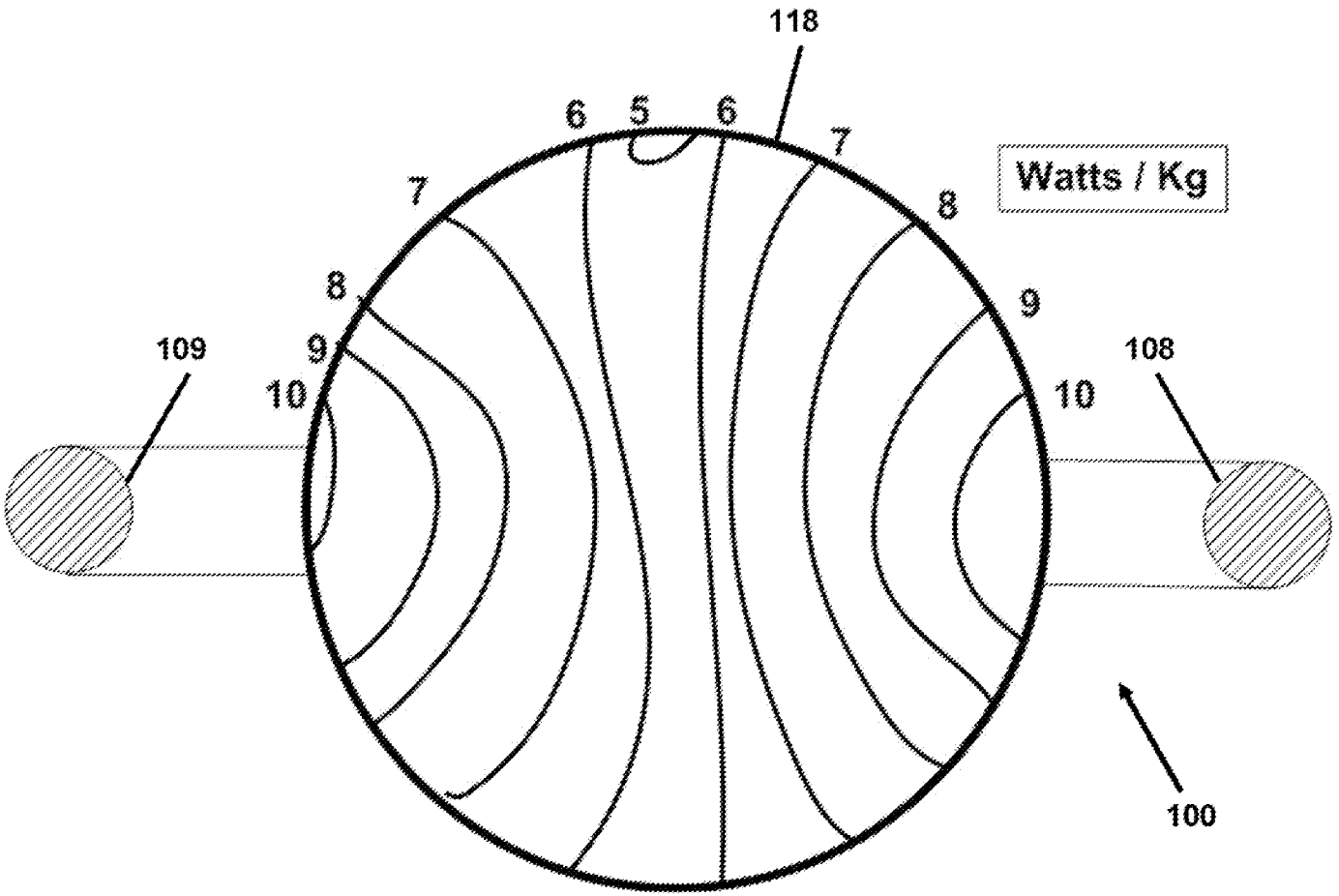
FIG. 3 depicts the heating pattern for the radio frequency heating fork with a target.

The placement of target 118 (see FIG. 2) may significantly modify near field phase and amplitude contours from those present during free space operation, and the derivation of the near field contours involving target 118 may be best accomplished by numerical electromagnetic methods. FIG. 3 is a profile cut contour plot of the specific absorption rate of heat in watts per kilogram for target 118 being heated by heating fork 100, with tines 108 and 109 on either side of target 118. The FIG. 3 plot was obtained by a method-of-moments analysis. The asymmetry seen is due to meshing granularity and would not be present in symmetric physical embodiments. As can be appreciated, the circular magnetic near fields from each of the antenna fork conductors add constructively in phase as the heating effect is nonzero in the target center. Exemplary operating parameters associated with FIG. 3 are listed in Table 1 below:

TABLE 1

| | |
|---|---|
| Application | Near field RF heating |
| Heating fork RF feed | Supply loop |
| Target material | Rich Athabasca oil sand, 15% bitumen |
| Target size | 10.2 cm diameter cylinder, 0.91 meters long |
| Target permittivity | 5 farads/meter |
| Target conductivity | 0.0017 mhos/meter |
| Target water content | 1.1% |
| Frequency | 6.78 MHz |
| Supply loop length | 1.05 meter |
| Supply loop width | 15.2 cm (same as heating fork) |
| Supply loop spacing from heating fork | 0.190 m center to center |
| Transmitter power | 1 kilowatt RMS |
| VSWR | Under 2.0 to 1 |
| Heating fork length | 3.1 meters |
| Spacing between fork conductors | 15.2 cm |
| Fork conductor diameter | 2.28 cm |
| Capacitor location | 1.33 meters from loop end |
| Capacitor capacitance | 317 pf |
| SAR rate in target | 5-10 watts/kilogram |
| H field amplitude in target | 0.1 to 0.4 amperes/meter |
| E field amplitude in target | ~8 kilovolts/meter |

The present radio frequency heating fork has been tested and found effective for the heating of petroleum ores, such as Athabasca oil sand in dielectric pipes. Referring to FIG. 2, in a large scale application heating fork tines 108 and 109 may comprise hollow metallic pipes to permit the withdrawal of radio frequency heated materials such as hydrocarbon ores or heavy oil, e.g. heating fork tines 108 and 109 may be comprised of solid wall or perforated wall well piping.

Frequency and electrical load management for the present radio frequency heating fork will now be discussed in reference to FIGS. 1 and 2. It may be preferred that heating fork 100 be operated at resonance for impedance matching and low VSWR to AC power source 102. Two methods for such operation involve variable frequency and fixed frequency operation. In the variable frequency method, AC power supply 102 is changed in frequency during heating to track the dielectric constant changes of target 118. This may be accomplished, for example, with a control system or by configuring AC power source as a power oscillator with heating fork 100 as the oscillator tank circuit. A second loop similar to supply loop 56 (see FIG. 1) may be used as tickler to drive the oscillator.

In a fixed frequency method, AC power source 52 may be held constant in frequency by crystal control, and the value of capacitor 62 varied to force a constant frequency of resonance from heating fork 50. The fixed frequency approach may be preferred if it is desired to avoid the need for shielding from excess RF radiation. For example, the fixed frequency approach may avoid the need for shielding by use of a RF heating frequency allocation. In the United States this may be in an Industrial, Scientific and Medical (ISM) band, e.g., at 6.78 Mhz, 13.56 Mhz, and other frequencies.

It is preferential to space tine 58 from tine 59 of RF heating fork 50, and tine 108 from tine 109 of RF heating fork 100, by about 3 or more tine diameters to avoid conductor proximity effect losses between the tines. Conductor proximity effect is a nonuniform current distribution that can occur with closely spaced conductors that increases loss resistance. Litz conductors may be useful with the present invention in low frequency embodiment of the present invention, say below about 1 MHz. The RF heating forks 50 and 100 may be operated in a vacuum or dielectric gas atmosphere such as sulfur hexafluoride ($SF_6$) to control corona discharges from open ends 66 and 112 at very high power levels. When uninsulated and in contact with a target media 118 that is conductive, heating forks 50 and 100 apply electric currents directly into the target media. Open ends 66 and 112 can function as electrodes if so configured.

Target 118 may comprise a heating puck, a dielectric pipe, or even a human patient undergoing a medical treatment. A method of the present invention is to place RF heating susceptors in the RF heating target for increased heating speed, or for selectively heating a specific region of the target. A RF heating susceptor is a material that heats preferentially in the presence of RF energies, such as, for example, graphite, titanates, ferrite powder, or even saltwater.

The present RF heating fork may also be useful for generating far fields and as an antenna when RF heating targets are not used. The orientation of the radiated far electric field is opposite that of heating fork orientation, e.g. a horizontally oriented heating fork produces a vertical polarized wave. The present RF heating forks are therefore useful for both near and far field heating, and for communications.

The present RF heating fork has multiple applications as a tool for RF heating, such as food and material processing, component separation and upgrading hydrocarbon ores, heat sealing and welding, and medical diathermy. The present RF heating fork may be operated at low frequencies for sufficient penetration, and by near fields for controlled radiation, thereby providing a selection of energy types E, H, and I.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged either in whole or in part. Therefore, the spirit and scope of the appended claims should not be limited to the description of the preferred versions contained herein.

The invention claimed is:

1. An apparatus for processing a petroleum ore comprising:
a radio frequency (RF) source;
an RF feed coupler coupled to said RF source;
a supply loop coupled to said RF feed coupler; and
an RF applicator inductively coupled to said RF source and comprising
an electrically conductive loop end at least partially overlapping said supply loop, and
a pair of electrically conductive elongate members having proximal ends coupled to said electrically conductive loop end and extending outwardly therefrom in a generally parallel spaced apart relation,
each of said pair of electrically conductive elongate members having distal ends configured to heat the petroleum ores adjacent thereto.

2. The apparatus of claim 1, wherein said RF source and said RF applicator are configured to generate dielectric heating adjacent the distal ends of said pair of electrically conductive elongate members.

3. The apparatus of claim 1, wherein said RF source and said RF applicator are configured to generate induction heating adjacent the proximal ends of said pair of electrically conductive elongate members.

4. The apparatus of claim 1, wherein said RF source and said RF applicator are configured to generate electric fields adjacent the distal ends of said pair of electrically conductive elongate members.

5. The apparatus of claim 1, wherein said RF source and said RF applicator are configured to generate magnetic fields adjacent the proximal ends of said pair of electrically conductive elongate members.

6. The apparatus of claim 1, wherein said RF feed coupler comprises a coaxial RF feed coupler.

7. The apparatus of claim 1, further comprising a capacitor coupled between said pair of electrically conductive elongate members.

8. A method for heating a petroleum ore comprising:
applying radio frequency (RF) power from an RF source to an RF applicator coupled to the RF source, the RF applicator comprising
an electrically conductive loop end at least partially overlapping a supply loop coupled to an RF feed coupler that is coupled to the RF source, and
a pair of electrically conductive elongate members having proximal ends coupled to the electrically conductive loop end and extending outwardly therefrom in a generally parallel spaced apart relation, each of the pair of electrically conductive elongate members having distal ends; and
positioning the petroleum ores adjacent each of the pair of electrically conductive elongate members to heat the petroleum ores with the RF power.

9. The method of claim 8, wherein applying RF power comprises applying RF power so that the RF source and the RF applicator cooperate to generate dielectric heating adjacent the distal ends of the pair of electrically conductive elongate members.

10. The method of claim 8, wherein applying RF power comprises applying RF power so that the RF source and the RF applicator cooperate to generate induction heating adjacent the proximal ends of the pair of electrically conductive elongate members.

11. The method of claim 8, wherein applying RF power comprises applying RF power so that the RF source and the RF applicator cooperate to generate electric fields adjacent the distal ends of the pair of electrically conductive elongate members.

12. The method of claim 8, wherein applying RF power comprises applying RF power so that the RF source and the RF applicator cooperate to generate magnetic fields adjacent the proximal ends of the pair of electrically conductive elongate members.

13. The method of claim 8, wherein applying RF power to the RF applicator comprises applying RF power to the RF applicator comprising an electrically conductive loop end at least partially overlapping the supply loop coupled to a coaxial RF feed coupler that is coupled to the RF source.

14. The method of claim 8, wherein applying RF power to the RF applicator comprises applying RF power to a capacitor coupled between the pair of electrically conductive elongate members.

15. An apparatus for processing a petroleum ore comprising:
a radio frequency (RF) source;
an RF feed coupler; and
a supply loop coupled to said RF feed coupler;
an RF applicator coupled to said RF source and comprising
an electrically conductive hollow pipe loop end at least partially overlapping said supply loop, and
a pair of electrically conductive elongate hollow pipes having proximal ends coupled to said electrically conductive hollow pipe loop end and extending outwardly therefrom in a generally parallel spaced apart relation,
each of said pair of electrically conductive elongate hollow pipes having distal ends configured to heat the petroleum ores adjacent thereto.

16. The apparatus of claim 15, wherein said RF source and said RF applicator are configured to generate dielectric heating adjacent the distal ends of said pair of electrically conductive elongate hollow pipes.

17. The apparatus of claim 15, wherein said RF source and said RF applicator are configured to generate induction heating adjacent the proximal ends of said pair of electrically conductive elongate hollow pipes.

18. The apparatus of claim 15, wherein said RF source and said RF applicator are configured to generate electric fields adjacent the distal ends of said pair of electrically conductive elongate hollow pipes.

19. The apparatus of claim 15, wherein said RF source and said RF applicator are configured to generate magnetic fields adjacent the proximal ends of said pair of electrically conductive elongate hollow pipes.

20. The apparatus of claim 15, further comprising a capacitor coupled between said pair of electrically conductive elongate hollow pipes.

21. The apparatus of claim 15 wherein said RF feed coupler comprises a coaxial RF feed coupler.

22. A method for heating a petroleum ore comprising:

applying radio frequency (RF) power from an RF source to an RF applicator coupled to the RF source, the RF applicator comprising an electrically conductive hollow pipe loop end at least partially overlapping a supply loop coupled to an RF feed coupler that is coupled to the RF source, and a pair of electrically conductive elongate hollow pipes having proximal ends coupled to the electrically conductive hollow pipe loop end and extending outwardly therefrom in a generally parallel spaced apart relation, each of the pair of electrically conductive elongate hollow pipes having distal ends; and positioning the petroleum ores adjacent each of the pair of electrically conductive elongate hollow pipes to heat the petroleum ores with the RF power.

23. The method of claim 22, wherein applying RF power comprises applying RF power so that the RF source and the RF applicator cooperate to generate dielectric heating adjacent the distal ends of the pair of electrically conductive elongate hollow pipes.

24. The method of claim 22, wherein applying RF power comprises applying RF power so that the RF source and the RF applicator cooperate to generate induction heating adjacent the proximal ends of the pair of electrically conductive elongate hollow pipes.

25. The method of claim 22, wherein applying RF power comprises applying RF power so that the RF source and the RF applicator cooperate to generate electric fields adjacent the distal ends of the pair of electrically conductive elongate hollow pipes.

26. The method of claim 22, wherein applying RF power comprises applying RF power so that the RF source and the RF applicator cooperate to generate magnetic fields adjacent the proximal ends of the pair of electrically conductive elongate hollow pipes.

27. The method of claim 22, wherein applying RF power to the RF applicator comprises applying RF power to a capacitor coupled between the pair of electrically conductive elongate members.

* * * * *